United States Patent [19]

Salerno

[11] 4,310,947

[45] Jan. 19, 1982

[54] SLIDING DOOR SAFETY DEVICE

[76] Inventor: Michael Salerno, 392 Ramapo Valley Rd., Oakland, N.J. 07436

[21] Appl. No.: 164,083

[22] Filed: Jun. 30, 1980

[51] Int. Cl.[3] ..... E05F 5/04

[52] U.S. Cl. ..... 16/83; 16/86 A

[58] Field of Search ..... 16/82, 83, 86 R, 86 A

[56] References Cited

U.S. PATENT DOCUMENTS

| | | | |
|---|---|---|---|
| 896,242 | 8/1908 | Ralston | 16/83 |
| 1,037,641 | 9/1912 | Koch, Jr. | 16/83 |
| 1,105,963 | 8/1914 | Clem | 16/86 A X |
| 1,649,339 | 11/1927 | Conley | 16/83 |
| 3,800,360 | 4/1974 | Knarreborg | 16/83 |
| 4,028,772 | 6/1977 | Salerno | 16/86 A |
| 4,165,553 | 8/1979 | Salerno | 16/86 A |

FOREIGN PATENT DOCUMENTS

| | | | |
|---|---|---|---|
| 9050 | of 1886 | United Kingdom | 16/86 A |
| 3663 | of 1911 | United Kingdom | 16/86 A |

*Primary Examiner*—Wm. Carter Reynolds

*Attorney, Agent, or Firm*—Daniel Jay Tick

[57] ABSTRACT

A support device pivotally supports a resilient body on the leading surface of either a door or sliding door frame in a manner whereby the gravitational force on the body moves the body between a sliding door and the frame. The body is mounted on a rod which is loosely accommodated in a mounting housing to prevent the transfer of the shock of impact of the door on the body to the housing. The body is manually movable away from the door and the frame, so that the body is positioned by gravitational force in abutment with the leading surface of the door when the door is closed. This permits the door to be securely closed with its leading edge in abutment with the frame. The body is interposed by gravitational force between the leading edge of the door and the frame when the door is open thereby preventing the door from closing fully by preventing the leading edge of the door from abutting the frame and thus protecting hands from being crushed between the door and the frame.

5 Claims, 15 Drawing Figures

FIG. 2
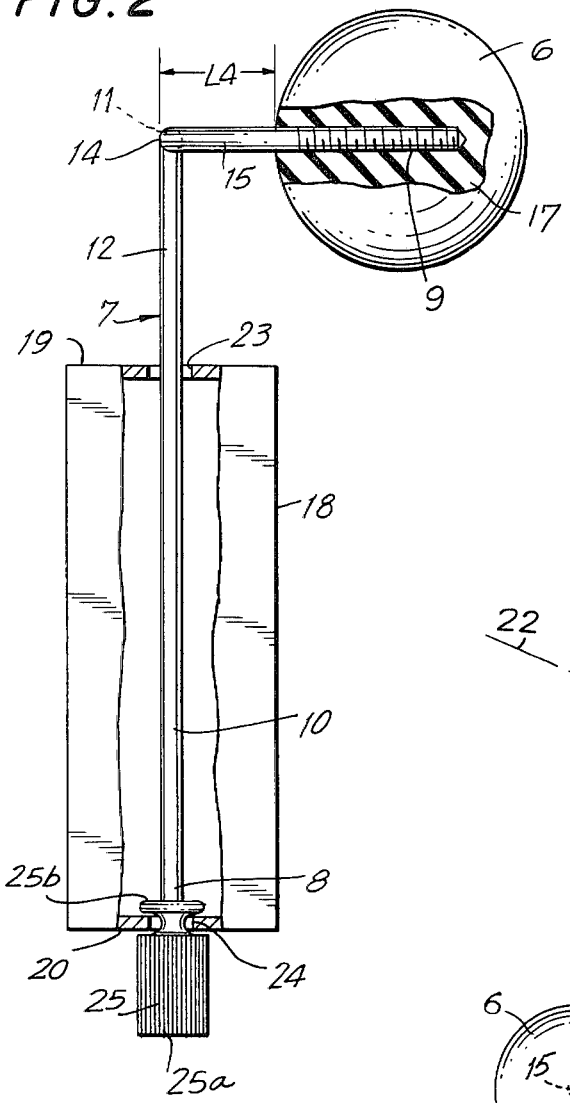
FIG. 4
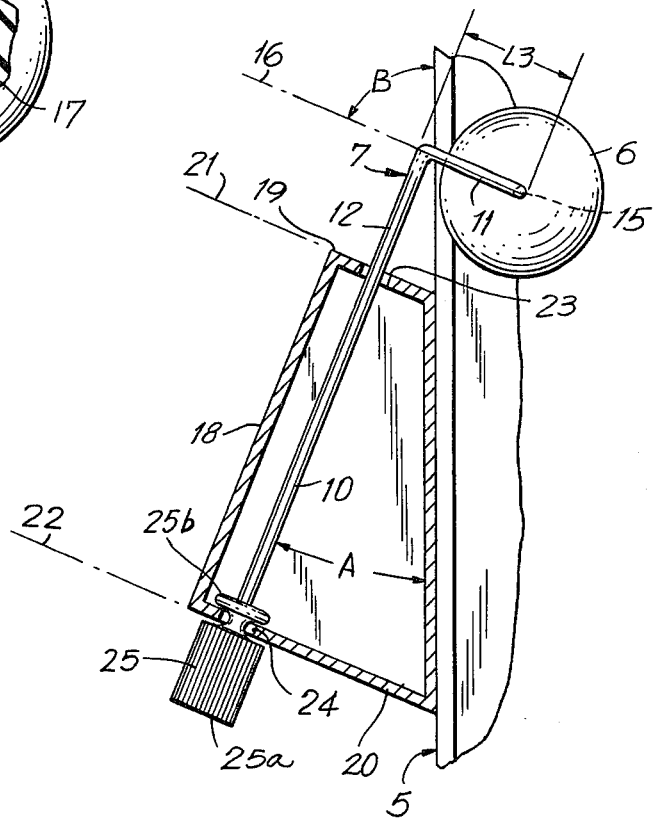
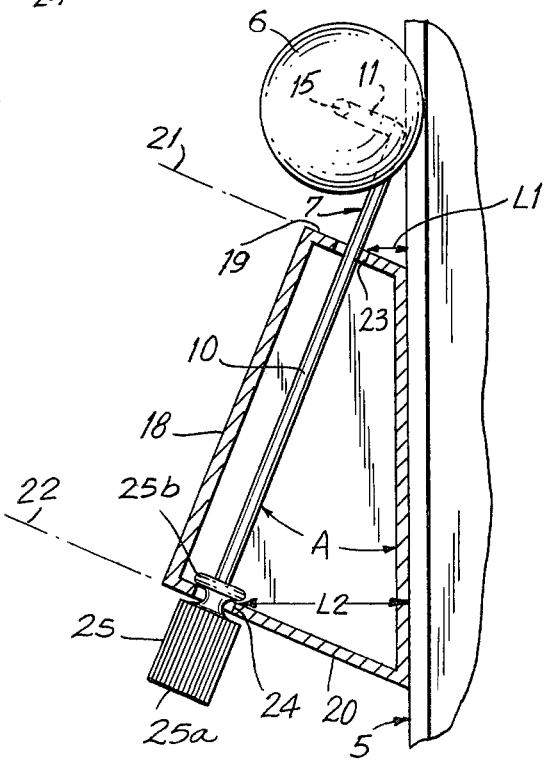
FIG. 5

SLIDING DOOR SAFETY DEVICE

BACKGROUND OF THE INVENTION

The present invention relates to a sliding door safety device. More particularly, the invention relates to a sliding door safety device for a sliding door slidably mounted in a door frame having a track slidably accommodating the door.

People, and especially children, are often injured when they have a hand caught between a sliding door and its frame when they or someone else pushes the door closed and is not aware of the dangerous position of the hand.

The principal object of the invention is to provide a sliding door safety device for preventing the fingers of unsuspecting people, and especially children, from being crushed between the door and the frame of a sliding door when the door is suddenly closed.

An object of the invention is to provide a sliding door safety device for preventing injury to people's hands when a sliding door is suddenly closed, which device is of simple structure and installable with facility and convenience for use with newly installed and old doors.

Another object of the invention is to provide a sliding door safety device which is inexpensive in manufacture and functions efficiently, effectively and reliably to prevent a sliding door from closing fully, thereby preventing the hand of an unsuspecting person from being crushed between the door and its frame when the door is suddenly closed.

BRIEF SUMMARY OF THE INVENTION

In accordance with the invention, a sliding door safety device for a sliding door slidably mounted in a door frame having a track slidably accommodating the door, the door having a leading edge which abuts the frame when the door is closed and a leading surface in the area of the leading edge, the frame having a leading surface which is next-adjacent the leading surface of the door when the door is closed, comprises a resilient ball. A support device pivotally supports the resilient ball on the leading surface of either the door or the frame in a manner whereby the gravitational force on the ball moves the ball between the door and the frame. The ball is manually movable away from the door and the frame, so that the ball is positioned by gravitational force in abutment with the leading surface of the frame or the door when the door is closed thereby permitting the door to be securely closed with its leading edge in abutment with the frame. The ball is interposed by gravitational force between the leading edge of the door and the frame when the door is open thereby preventing the door from closing fully by preventing the leading edge of the door from abutting the frame and thus protecting hands from being crushed between the door and the frame. The support device comprises a rod of predetermined diameter having spaced opposite first and second ends. The rod has a linear part extending for most of its length from the first end and being bent in the area of its second end in a manner whereby the second end is spaced at a substantially radial distance from the linear part. The ball is mounted on the second end of the rod. A mounting device pivotally mounts the rod at an acute angle with the leading surface of the door or the frame in a manner whereby the ball is rotatable in an operating plane perpendicular to the linear part and at an acute angle with the leading surface of the door or the frame.

The mounting device comprises a housing affixed to the leading surface of the door or the frame and having spaced substantially parallel top and bottom parts extending in planes spaced below and substantially parallel to the operating plane. The top part has a top hole formed therethrough. The top hole has a diameter sufficiently greater than the predetermined diameter to accommodate the rod loosely. The bottom part has a bottom hole formed therethrough. The top and bottom holes pivotally accommodate the rod with the first end of the rod passing through the bottom hole and the area of the end of the linear part adjacent the bent area of the rod passing through the top hole. Most of the linear part of the rod is in the housing and the bent area of the rod is outside of the housing.

The bottom hole has a diameter sufficiently greater than the predetermined diameter to accommodate the rod loosely.

The first end of the rod is outside the housing. A bushing is provided in the bottom hole of the housing and is affixed to the first end of the rod and is rotatable therewith for manually rotating the rod to return the ball from a position between the door and the frame to a position in abutment with the leading surface of the frame or the leading surface of the door.

The bushing has a knurled knob part outside the housing for manual rotation of the bushing and the rod and a flange part inside the housing for preventing the bushing and the rod from axial movement more than a predetermined tolerance.

The top hole is spaced a predetermined distance from the leading surface of the frame. The bottom hole is spaced approximately one and one half times the predetermined distance from the leading surface of the frame.

The rod is severed in its linear part at a point outside the housing and above the top part of the housing. A rod coupling device at the severed ends of the linear part of the rod removably joins the severed ends to each other thereby permitting differently bent second end areas of the rod to be coupled to the linear part thereof to enable the sliding door safety device to be mounted at opposite ends and on opposite sides of the door.

The rod coupling device comprises external threading at one of the severed ends, an eye member extending from the other of the severed ends for accommodating the one of the ends and a nut threadedly coupled to the one of the ends for retaining the eye member tightly on the one of the ends whereby the ball is movable with the rod.

The rod is bent in the area of its second end at substantially right angles with the linear part to form a first arm extending from the end of the linear part adjacent the bent area. The first arm and the linear part form a first support plane. The rod is bent again at the end of the first arm farthest from the linear part at substantially right angles with the first arm to form a second arm extending from the end of the first arm. The first and second arms form the operating plane perpendicular to the first support plane and to the linear part.

The rod is severed at a point where its linear part meets its first arm.

The ball is removably adjustably mounted on the second end of the rod in a manner whereby the distance of the ball from the linear part of the rod is selectively adjustable.

The ball is removably adjustably mounted on the second end of the rod at the free end of the second arm in a manner whereby the distance of the ball from the first arm is selectively adjustable.

The second arm of the rod is severed. An arm coupling device at the severed ends of the second arm removably joins the severed ends to each other thereby permitting the second arm to be selectively varied in length.

The linear part of the rod is positioned at a predetermined acute angle with the leading surface of the frame. The first arm has a predetermined length between the linear part and the second arm. The second arm has a length between the first arm and the ball.

The arm coupling device comprises a first tubular part extending coaxially from one of the severed ends of the second arm and having a plurality of spaced radial holes formed therethrough. A second tubular part extends coaxially from the other of the severed ends of the second arm and is dimensioned to slide in axial directions in the first tubular part. The second tubular part is axially slidably mounted in the first tubular part and has a protrusion extending radially therefrom at the free end thereof for extending into each of the holes when it is positioned thereat. This releasably secures the second tubular part at a selected one of a plurality of different positions indicated by the holes thereby selectively varying the length of the second arm. The protrusion leaves a hole into which it extends under manual pressure applied to slide the second tubular part in the first tubular part.

The linear part of the rod is positioned at an acute angle with the leading surface of the frame greater than the predetermined acute angle.

The length of the second arm is substantially equal to the predetermined length of the first arm, in one embodiment of the invention.

The length of the second arm is greater than the predetermined length of the first arm in another embodiment of the invention and is approximately twice the predetermined length of the first arm.

In accordance with the invention, a sliding door safety device for a sliding door slidably mounted in a door frame having a track slidably accommodating the door, the door having a leading edge which abuts the frame when the door is closed and a leading surface in the area of the leading edge, the frame having a leading surface which is next-adjacent the leading surface of the door when the door is closed, comprises a resilient ball. A support device pivotally supports the resilient ball on the leading surface of the door or on the leading surface of the frame in a manner whereby the ball is movable between the door and the frame. The ball is manually movable away from the door and the frame. The support device comprises a rod of predetermined diameter having spaced opposite first and second ends. The rod has a linear part extending for most of its length from the first end. The rod is bent in the area of its second end in a manner whereby the second end is spaced at a substantially radial distance from the linear part. The ball is mounted on the second end of the rod. A mounting device pivotally mounts the rod at an acute angle with the leading surface of the door or the frame in a manner whereby the ball is rotatable in an operating plane perpendicular to the linear part and at an acute angle with the leading surface of the door or the frame. The mounting device comprises a housing affixed to either the door or the leading surface of the frame and having spaced substantially parallel top and bottom parts extending in planes spaced below and substantially parallel to the operating plane. The top part has a top hole formed therethrough. The top hole has a diameter sufficiently greater than the predetermined diameter to accommodate the rod loosely. The bottom part has a bottom hole formed therethrough. The bottom hole has a diameter sufficiently greater than the predetermined diameter to accommodate the rod loosely. The top and bottom holes pivotally accommodate the rod with the first end of the rod passing through the bottom hole and the area of the end of the linear part adjacent the bent area of the rod passing through the top hole. Most of the linear part of the rod is in the housing and the bent area of the rod is outside of the housing. A spring has one end affixed to the rod in the housing and a spaced opposite end affixed to the housing. The spring forces the ball into abutment with the leading surface of the frame or the door when the door is closed thereby permitting the door to be securely closed with its leading edge in abutment with the frame. The spring forces the ball to an interposed position between the leading edge of the door and the frame when the door is open. This prevents the door from closing fully by preventing the leading edge of the door from abutting the frame and thus protecting hands from being crushed between the door and the frame.

The first end of the rod is outside the housing. A bushing in the bottom hole is affixed to the first end of the rod and is rotatable therewith for manually rotating the rod against the action of the spring to return the ball from a position between the door and the frame to a position in abutment with the leading surface of the frame and the leading surface of the door.

BRIEF DESCRIPTION OF THE DRAWINGS

In order that the invention may be readily carried into effect, it will now be described with reference to the accompanying drawings, wherein:

FIG. 2 is a view, on an enlarged scale, partly cut away and partly in section, of the embodiment of FIGS. 1A and 1B;

FIG. 4 is a schematic diagram, partly in section, of the embodiment of FIGS. 1A and 1B in operative position;

FIG. 5 is a schematic diagram, partly in section, of the embodiment of FIGS. 1A and 1B in inoperative position;

DETAILED DESCRIPTION OF THE INVENTION

Figure 1A:
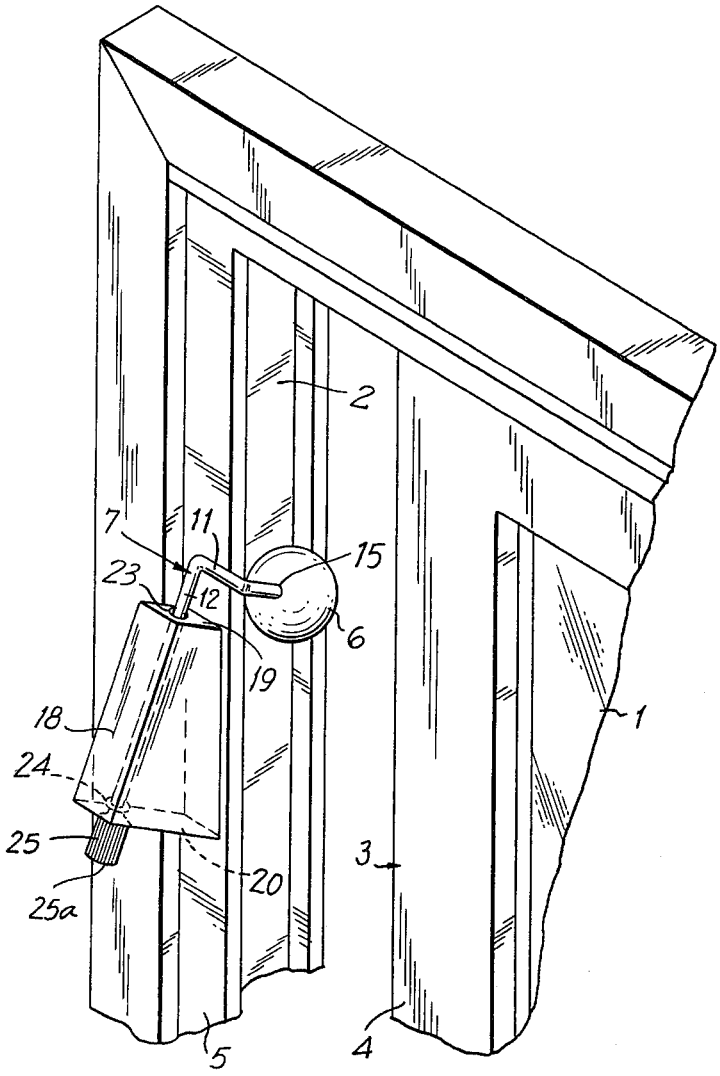
FIG. 1A is a perspective view of a first embodiment of the sliding door safety device of the invention, mounted on a door frame and in operative position.
Figure 1B:
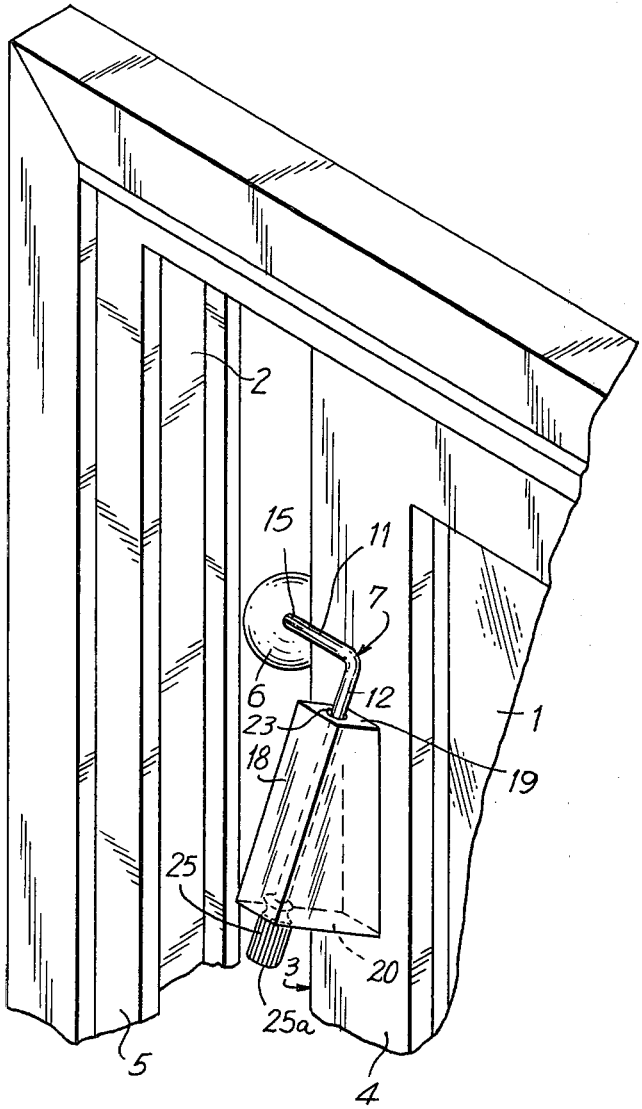
FIG. 1B is a perspective view of the embodiment of the sliding door safety device of FIG. 1A, mounted on a door and in operative position.
Figure 8:
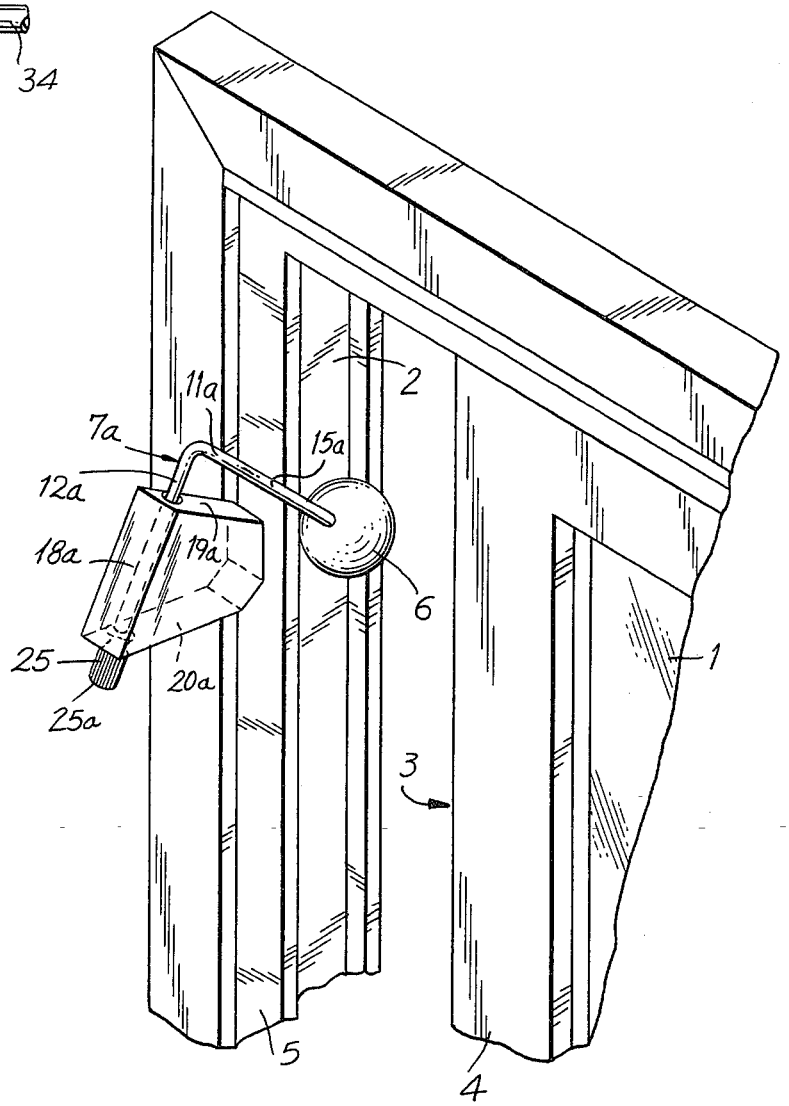
FIG. 8 is a perspective view of a third modification of the embodiment of FIGS. 1A and 1B.

The sliding door safety device of the invention is for a sliding door 1 (FIGS. 1A, 1B and 8) slidably mounted in a door frame 2 (FIGS. 1A, 1B and 8) having a track (not shown in the FIGS.) slidably accommodating the door. The door 1 has a leading edge 3, which abuts the frame 2 when said door is closed, and a leading surface 4 in the area of said leading edge, as shown in FIGS. 1A, 1B and 8. The frame 2 has a leading surface 5 (FIGS. 1A, 1B, 4, 5, 8, 10 and 11) which is next-adjacent the leading surface 4 of the door 1 when said door is closed.

The sliding door safety device of the invention comprises a resilient body or ball 6 (FIGS. 1A and 1B to 12) of any suitable material such as, for example, rubber.

In the first embodiment of the invention (FIGS. 1A and 1B to 11), a support device pivotally supports the resilient body 6 either on the leading surface 5 of the frame 2, as shown in FIG. 1A, or on the leading surface 4 of the door 1, as shown in FIG. 1B, in a manner whereby the gravitational force on said body moves said body between the door 1 and said frame, as shown in FIGS. 1A, 1B and 8. The body or ball 6 is manually movable away from the door 1 and the frame 2, so that said body is positioned by gravitational force in abutment with the leading surface 4 of said door when said door is closed, thereby permitting said door to be securely closed with its leading edge 3 in abutment with said frame.

The body 6 is interposed by gravitational force between the leading edge 3 of the door 1 and the frame 2 when said door is open, as shown in FIGS. 1A, 1B and 8, thereby preventing said door from closing fully by preventing said leading edge of said door from abutting said frame and thus protecting hands from being crushed between said door and said frame.

The support device of the first embodiment of the invention comprises a rod 7 (FIGS. 1A and 1B to 5) of predetermined diameter D1 (FIG. 3) having spaced opposite first and second ends 8 and 9, respectively, as shown in FIG. 2. The rod 7 has a linear part 10 (FIGS. 2, 4 and 5) extending for most of its length from the first end 8 thereof. The rod 7 is bent in the area of its second end 9 in a manner whereby said second end is spaced at a substantially radial distance from the linear part 10.

Figure 3:
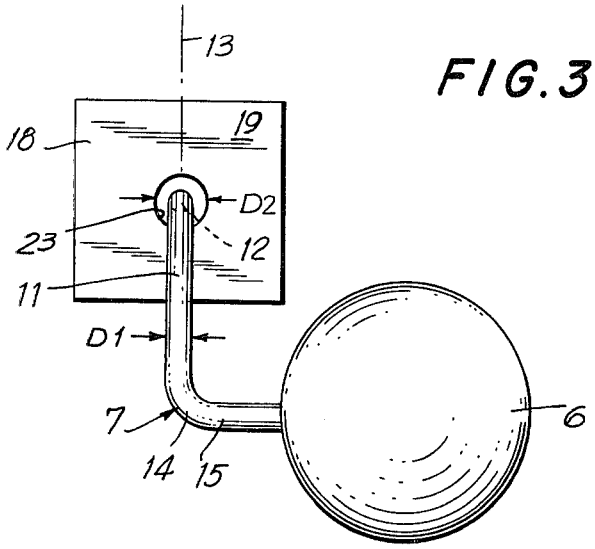
FIG. 3 is a top view of the embodiment of FIGS. 1A and 1B.

The rod 7 of the first embodiment of the invention is bent in the area of its second end 9 at substantially right angles with the linear part 10 of said rod to form a first arm 11 extending from the end 12 of said linear part adjacent the bent area, as shown in FIGS. 2 to 4. The first arm 11 and the linear part 10 forms a first support plane 13 (FIG. 3). The rod 7 is bent again at the end 14 of the first arm 11 farthest from the linear part 10 at substantially right angles with said first arm, as shown in FIGS. 2 and 3, to form a second arm 15 extending from said end of said first arm, as shown in FIGS. 1A, 1B, 2 and 3. The first and second arms 11 and 15 form an operating plane 16 (FIG. 4) perpendicular to the first support plane 13 and to the linear part 10. The operating plane 16 is further described hereinafter.

The resilient body or ball 6 is mounted on the second end 9 of the rod 7 by any suitable device and may be fixedly or rotatably mounted on said rod. As shown in FIG. 2, the ball 6 is removably adjustably mounted on the rod 7 by being threadedly coupled to said rod. The free second arm 15 of the end 9 of the rod 7 is externally threaded and the ball 6 has an internally threaded tubular bore therein cooperatively coupled to said rod. The distance of the ball 6 from the linear part 10 and from the first arm 11 of the rod 7 is thus selectively adjustable. The body 6 may be mounted on the rod 7 by being impaled thereon.

A mounting device pivotally mounts the rod 7 at an acute angle A with the leading surface 5 of the frame 2, as shown in FIGS. 1A, 4 and 5, in a manner whereby the body 6 is rotatable in the operating plane 16. The operating plane 16 is at an acute angle B with the leading surface 5 of the frame 2, as shown in FIG. 4. A mounting device pivotally mounts the rod 7 at an acute angle with the leading surface 4 of the door 1, as shown in FIG. 1B, in a manner whereby the body 6 is rotatable about the operating plane 16, which is at an acute angle with said leading surface.

The mounting device comprises a housing 18 (FIGS. 1A and 1B to 5) affixed to the leading surface 5 of the frame 2, as shown in FIGS. 1A, 4 and 5 or to the leading surface 4 of the door 1, as shown in FIG. 1B. The housing 18 has spaced substantially parallel top and bottom parts 19 and 20, respectively, extending in planes 21 and 22, respectively, spaced below and substantially parallel to the operating plane 16, as shown in FIGS. 4 and 5. The top part 19 of the housing 18 has a top hole 23 (FIGS. 2 to 5) formed therethrough. The top hole 23 has a diameter D2 (FIG. 3) sufficiently greater than the diameter D1 of the rod 7 to accommodate said rod loosely. This permits the rod 7 to "float" and thereby prevents said rod from transferring the shock of impact of the closing door 1 to the housing 18. The bottom part 20 of the housing 18 has a bottom hole 24 formed therethrough (FIGS. 2, 4 and 5). The diameter of the bottom hole 24 is sufficiently greater than the diameter D1 of the rod 7 to accommodate said rod loosely. The top and bottom holes 23 and 24 pivotally accommodate the rod 7 with the first end 8 of said rod passing through the bottom hole 24 (FIGS. 2, 4 and 5). The area of the end 12 of the linear part 10 adjacent the bent area of the rod 7 passes through the top hole 23 (FIGS. 2 to 5). Most of the linear part 10 of the rod 7 is in the housing 18 and the bent area of said rod is outside of said housing (FIGS. 1 to 5).

A bushing 25 (FIGS. 1A, 1B, 2, 4, 5, 6A, 8, 10, 11 and 12) may be positioned coaxially in the bottom hole 24, as shown in FIGS. 2, 4, 5, 6A, 10, 11 and 12. The top hole 23 is spaced a predetermined distance L1 from the leading surface 5 of the frame 2, as shown in FIG. 5, when the housing 18 is affixed to said leading surface, and is spaced said predetermined distance from the leading surface 4 of the door 1, when said housing is affixed to said leading surface of said door. The bottom hole 24 is spaced a distance L2, which is approximately one and one half times the distance L1, from the leading surface 5 of the frame 2 (FIG. 5), when the housing 18 is affixed to said leading surface, and is spaced the distance L2 from the leading surface 4 of the door 1, when said housing is affixed to said leading surface of said door.

Figure 11:
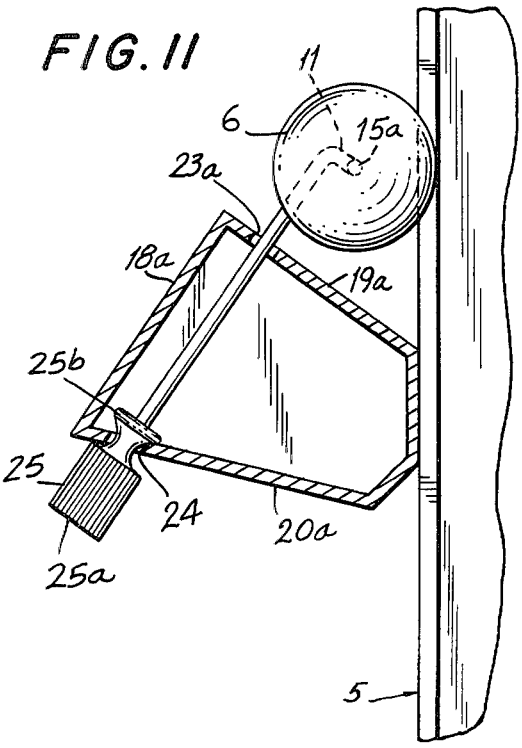
FIG. 11 is a schematic diagram, on a reduced scale, partly in section, of the modification of FIG. 8 in inoperative position.

The bushing 25 (FIGS. 1A, 1B, 2, 4, 5, 6A, 8, 10, 11 and 12) is coaxially affixed to the first end 8 of the rod 7 and is rotatable with said rod. The bushing 25 is used to manually rotate the rod 7 to return the ball 6 from its operative position between the door 1 and the frame 2, as shown in FIGS. 1A, 1B, 4, 8 and 10, to its inoperative position in abutment with the leading surface 4 of said door, as shown in FIGS. 5 and 11. The bushing 25 has a knurled knob part 25*a* (FIGS. 1A, 1B, 2, 4, 5, 6A, 8, 10, 11 and 12) outside the housing 18 and a flange part 25*b* (FIGS. 2, 4, 5, 6A, 10, 11 and 12) inside said housing. The flange part 25*b* prevents the bushing 25, and thus the rod 7, affixed thereto, from axial movement more than a predetermined tolerance. The knob part 25*a* facilitates manual rotation of the bushing 25, and thus the rod 7.

The first arm 11 has a predetermined length L3 between the linear part 10 and the second arm 15 (FIG. 4). The second arm 15 has a length L4 between the first arm 11 and the ball 6 (FIG. 2). The length L4 of the second arm 15 is substantially equal to the length L3 of the first arm 11, in the embodiments of FIGS. 1A and 1B to 5.

In the third modification of FIGS. 8 to 11, in which the same components of FIGS. 1A and 1B to 5 are identified by the same reference numbers, the linear part 10*a* of the rod 7*a* is positioned at an acute angle C (FIG. 10) with the leading surface 5 of the frame 2, greater than the angle A at which the rod 7 of the first embodiment is positioned relative to said leading surface.

Figure 9:
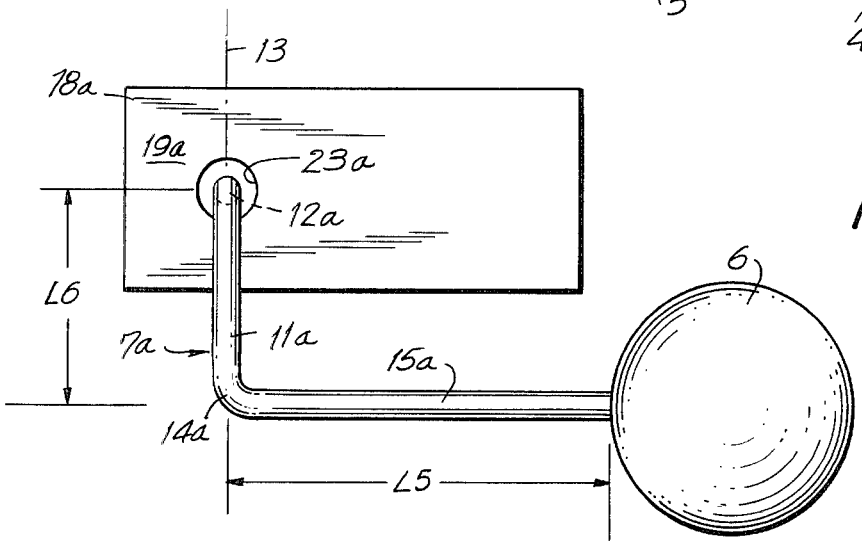
FIG. 9 is a top view of the modification of FIG. 8.
Figure 10:
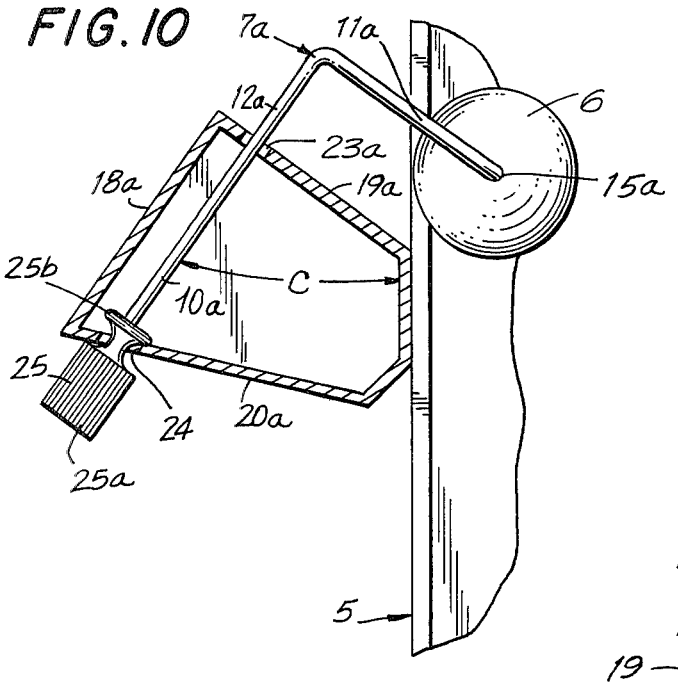
FIG. 10 is a schematic diagram, on an enlarged scale, partly in section, of the modification of FIG. 8 in operative position.

In the third modification of FIGS. 8 to 11, the length L5 of the second arm 15*a*, between the first arm 11*a* and the ball 6, as shown in FIG. 9, is greater than the length L6 of said first arm, between the linear part 10*a* and said second arm, as shown in FIG. 9. The length L5 of the second arm 15*a* of the rod 7*a* is approximately twice the length L6 of the first arm 11*a* of said rod.

Figure 6A:
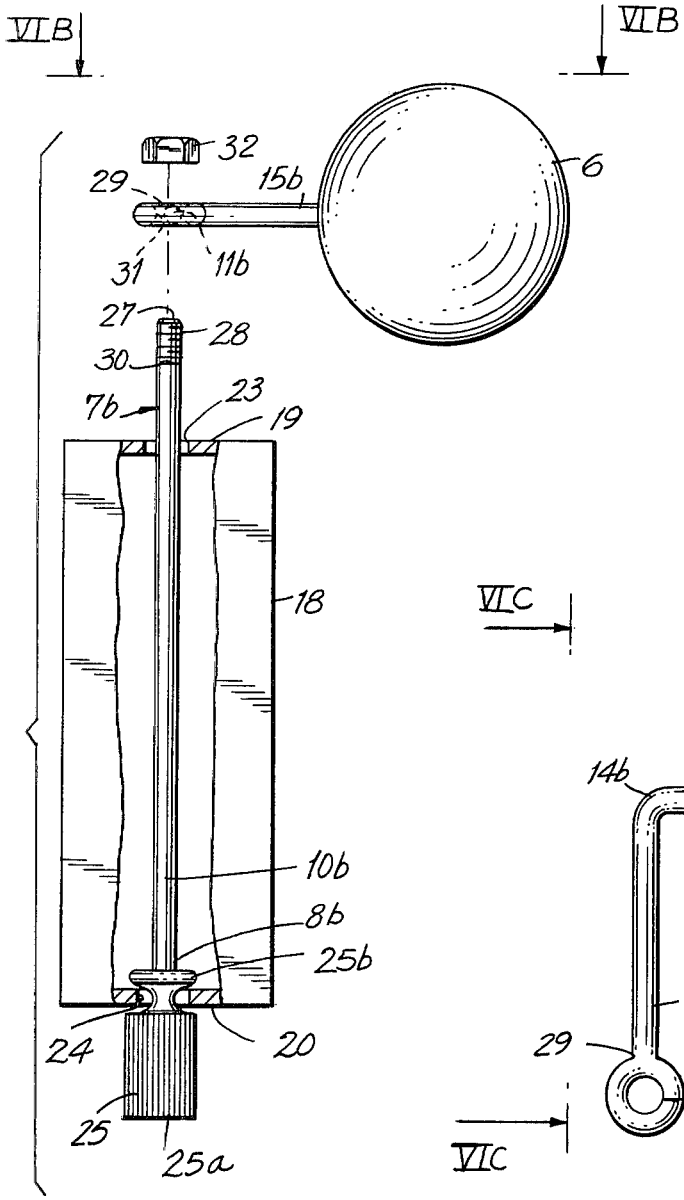
FIG. 6A is a view, on an enlarged scale, partly cut away and partly in section, of a first modification of the embodiment of FIGS. 1A and 1B.
Figure 6B:
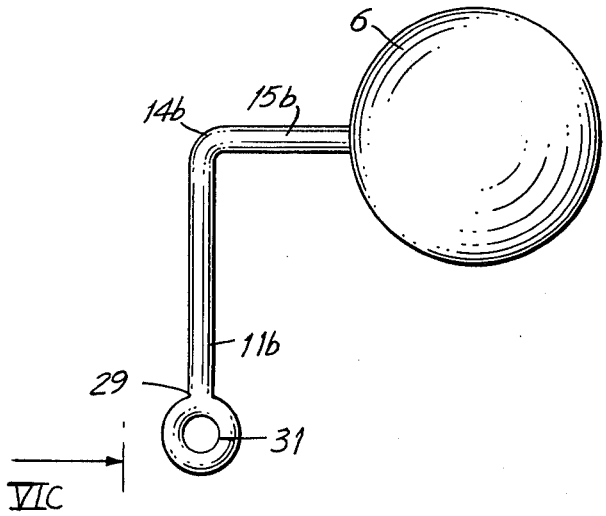
FIG. 6B is a view, taken along the lines VIB—VIB of FIG. 6A.
Figure 6C:
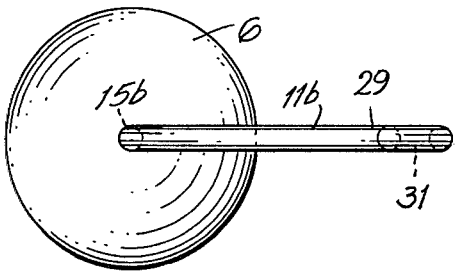
FIG. 6C is a view, taken along the lines VIC—VIC of FIG. 6B, rotated 180° about the axis of the arm 11 and then rotated 90° about the axis of the eye member.

In the first modification, of FIG. 6A, the rod 7*b* is severed at a point 27, outside the housing 18 and above the top part 19 of said housing, where its linear part 10*b* meets its first arm 11*b*. A rod coupling device at the severed ends 28 and 29, of the rod 7*b* (FIGS. 6A, 6B and 6C) removably joins said severed ends to each other. This permits differently bent second end areas of the rod to be coupled to the linear part 10*b* of said rod to enable the sliding door safety device of the invention to be mounted at opposite ends and on opposite sides of the door 1 or frame 2. Thus, the right-hand second end area 15*b* of the rod 7*b* (FIGS. 6A and 6B) permits the sliding door safety device of the invention to be mounted on a door frame 2 to the left of the door, as shown in FIGS. 1A, 4, 8 and 10. The left-hand second end area of the rod 7*b* permits the sliding door safety device of the invention to be mounted on a door 1 to the right of the door frame 2, as shown in FIG. 1B, or on a door frame to the right of the door (not shown in the FIGS.).

The rod coupling device may comprise any suitable coupling device such as, for example, external threading 30 at one of the severed ends 28 and 29 such as, for example, the end 28 (FIG. 6A). An eye member 31 (FIGS. 6A, 6B and 6C) extends from the other of the severed ends such as, for example, the end 29 (FIGS. 6A, 6B and 6C) for accommodating the end 28. A nut 32 is threadedly coupled to the end 28 of the rod 7*b* and presses the eye member 31 tightly against the unthreaded portion of the rod, so that the eye member is tightly maintained on said end (FIG. 6A) and the ball 6 is movable with said rod under the control of the knob 25*a*.

Figure 7:
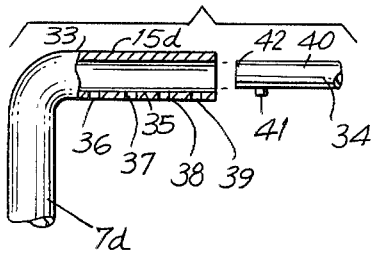
FIG. 7 is a view, on an enlarged scale, partly cut away and partly in section, of a second modification of the embodiment of FIGS. 1A and 1B.

In the second modification of the invention, of FIG. 7, the second arm 15*d* of the rod 7*d* is severed. An arm coupling device at the severed ends 33 and 34, respectively, of the second arm 15*d* removably joins said severed ends to each other. This permits the second arm 15*d* to be selectively varied in length.

The arm coupling device may comprise any suitable coupling device such as, for example, a first tubular part 35 extending coaxially from one of the severed ends 33 and 34 of the second arm 15*d* such as, for example, the end 33, as shown in FIG. 7. The first tubular part 35 has a plurality of radial holes 36, 37, 38 and 39 formed therethrough, as shown in FIG. 7. A second tubular part 40 extends coaxially from the other of the severed ends 33 and 34 of the second arm 15*d* (FIG. 7) such as, for example, the end 34. The second tubular part 40 is dimensioned to slide in axial directions in the first tubular part 35 and is axially slidably mounted in said first tubular part.

The second tubular part 40 has a protrusion 41 (FIG. 7) extending radially therefrom at the free end 42 thereof. The protrusion 41 extends into each of the holes 36, 37, 38, 39 when it is positioned thereat, thereby releasably securing the second tubular part 40 at a selected one of a plurality of different positions indicated by said holes. This results in a selective variation of the length of the second arm 15*d*. The protrusion 41 is forced out of a hole into which it extends by manual pressure applied to slide the second tubular part 40 in the first tubular part 35.

In the second embodiment of the invention (FIG. 12), a support device pivotally supports the resilient body 6 on the leading surface 5 (not shown in FIG. 12) of the frame 2 (not shown in FIG. 12) in a manner whereby said body or ball is movable between the door 1 (not shown in FIG. 12) and said frame. The ball 6 is manually movable away from the door 1 and the frame 2.

The body 6 is interposed by gravitational force between the leading edge 3 of the door 1 and the frame 2 when said door is open, as shown in FIGS. 1A, 1B, 4 and 8, thereby preventing said door from closing fully by preventing said leading edge of said door from abutting said frame and thus protecting hands from being crushed between said door and said frame.

The support device of the second embodiment of the invention comprises a rod 7 (FIG. 12) of predetermined diameter D1 (FIG. 3) having spaced opposite first and second ends 8 (FIG. 12) and 9 (not shown in FIG. 12), respectively. The rod 7 has a linear part 10 (FIG. 12) extending for most of its length from the first end 8 thereof. The rod 7 is bent in the area of its second end in a manner whereby said second end is spaced at a substantially radial distance from the linear part 10, as in the first embodiment of the invention.

Figure 12:
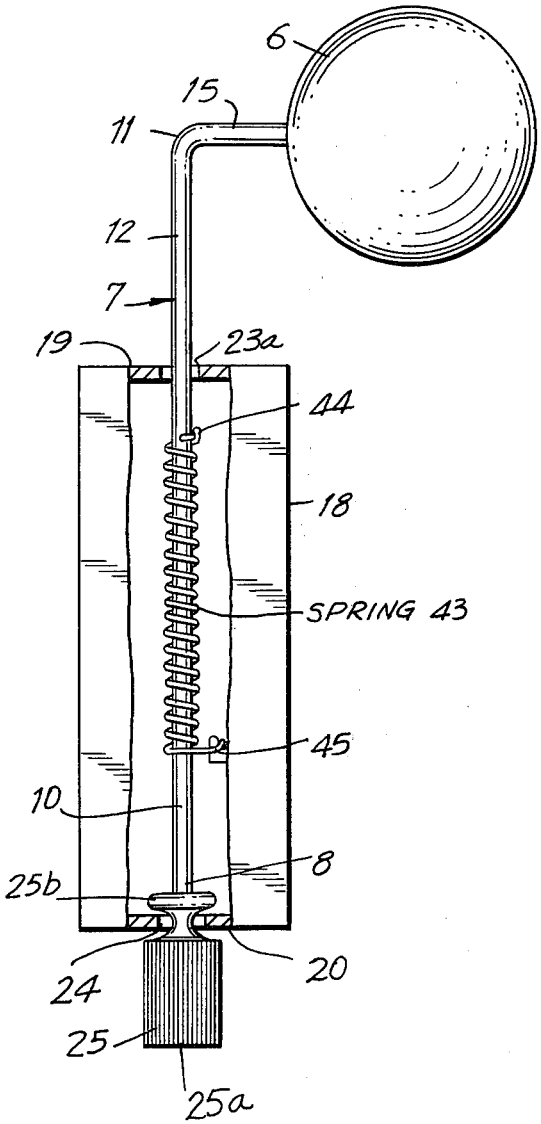
FIG. 12 is a view, on an enlarged scale, partly cut away and partly in section, of a second embodiment of the sliding door safety device of the invention, mounted on a door frame and in operative position.

The rod 7 of the second embodiment of the invention is bent in the same manner as in the first embodiment of the invention. Thus, in the second embodiment of the invention, the rod 7 is bent in the area of its second end 9 at substantially right angles with the linear part 10 of said rod to form a first arm 11 extending from the end 12 of said linear part adjacent the bent area, as shown in FIG. 12. The first arm 11 and the linear part 10 form a first support plane 13 (FIG. 3). The rod 7 is bent again at the end 14 of the first arm 11 farthest from the linear part 10 at substantially right angles with said first arm, as shown in FIGS. 2 and 3, to form a second arm 15 extending from said end of said first arm, as shown in FIGS. 1A, 1B, 2, 3 and 12. The first and second arms 11 and 15 form an operating plane 16 (FIG. 4) perpendicular to the first support plane 13 and to the linear part 10.

The resilient ball 6 is mounted on the second end 9 of the rod 7 in the same manner as the first embodiment of the invention. A mounting device pivotally mounts the rod 7 at an acute angle with the leading surface 5 of the frame 2, as in the first embodiment of the invention, in a manner whereby the ball 6 is rotatable in the operating plane 16.

The mounting device of the second embodiment of the invention is the same as that of the first embodiment of the invention and comprises a housing 18 (FIG. 12) affixed to the leading surface 5 of the frame 2. The housing 18 has spaced substantially parallel top and bottom parts 19 and 20, respectively, extending in planes 21 and 22, respectively, spaced below and substantially parallel to the operating plane 16, as shown in FIGS. 4 and 5. The top part 19 of the housing 18 has a top hole 23*a* (FIG. 12) formed therethrough. The top hole 23*a* has a diameter D2 (FIG. 3) sufficiently greater than the diameter D1 of the rod 7 to accommodate said rod loosely. This permits the rod 7 to "float" and thereby prevents said rod from transferring the shock of impact of the closing door 1 to the housing 18. The bottom part 20 of the housing 18 has a bottom hole 24 formed therethrough (FIG. 12). The bottom hole 24 has a diameter sufficiently greater than the diameter D1 of the rod 7 to accommodate said rod loosely. The top and bottom holes 23*a* and 24 pivotally accommodate the rod 7 with the first end 8 of said rod passing through the bottom hole 24 (FIG. 12). The area of the end 12 of the linear part 10 adjacent the bent area of the rod 7 passes through the top hole 23*a* (FIG. 12). The linear part 10 of the rod 7 is in the housing 18 and the bent area of said rod is outside of said housing (FIG. 12).

As in the first embodiment of the invention, a bushing 25 may be positioned coaxially in the bottom hole 24, as shown in FIG. 12. The bushing 25 is coaxially affixed to the first end 8 of the rod 7 and is rotatable with said rod. The bushing 25 has a knob part 25*a* used to manually rotate the rod 7 to return the ball 6 from its operative position between the door 1 and the frame 2, as shown in FIGS. 1A and 1B, to its inoperative position in abutment with the leading surface 4 of said door, as shown in FIG. 5. The bushing 25 also has a flange part 25*b* for preventing said bushing and the rod 7 from axial movement more than a predetermined tolerance.

In the second embodiment of the invention, shown in FIG. 12, a spring 43 has one end 44 affixed to the rod 7 in the housing 18 and a spaced opposite end 45 affixed to said housing as shown in FIG. 12. The spring 43 forces the ball 6 into abutment with the leading surface 5 of the door 1 when said door is closed, because said spring constantly urges said ball toward said surface. This permits the door 1 to be securely closed with its leading edge in abutment with the frame 2.

The spring 43 forces the ball 6 to an interposed position between the leading edge of the door and the frame when said door is open. This prevents the door from closing fully by preventing the leading edge of said door from abutting said frame, thereby protecting hands from being crushed between said door and said frame.

The knob part 25*a* facilitates manual rotation of the rod 7 against the action of the spring 43 to return the ball 6 from a position between the door and the frame to a position in abutment with the leading surface 4 of the door 1.

While the invention has been described by means of specific examples and in specific embodiments, I do not wish to be limited thereto, for obvious modifications will occur to those skilled in the art without departing from the spirit and scope of the invention.

I claim:

1. A sliding door safety device for a sliding door slidably mounted in a door frame having a track slidably accommodating the door, said door having a leading edge which abuts the frame when the door is closed and a leading surface in the area of the leading edge, said frame having a leading surface which is next-adjacent the leading surface of the door when the door is closed, said sliding door safety device comprising a resilient ball;

support means pivotally supporting the resilient ball on one of the leading surface of the door and the leading surface of the frame in a manner whereby the gravitational force on said ball moves said ball between the door and the frame, said ball being manually movable away from said door and said frame, so that said ball is positioned by gravitational force in abutment with the leading surface of one of said frame and said door when said door is closed thereby permitting said door to be securely closed with its leading edge in abutment with said frame, and is interposed by gravitational force between said leading edge of said door and said frame when said door is open thereby preventing the door from closing fully by preventing said leading edge of said door from abutting said frame and thus protecting hands from being crushed between said door and said frame, said support means comprising a rod of predetermined diameter having spaced opposite first and second ends, said rod having a linear part extending for most of its length from the first end and being bent in the area of its second end in a manner whereby said second end is spaced at a substantially radial distance from said linear part, said ball being mounted on the second end of said rod, and mounting means for pivotally mounting said rod at an acute angle with one of said leading surface of said door and said leading surface of said frame in a manner whereby said ball is rotatable in an operating plane perpendicular to said linear part and at an acute angle with one of said leading surface of said door and said frame, said mounting means comprising a housing affixed to one of said leading surface of said door and said leading surface of said frame and having spaced substantially parallel top and bottom parts extending in planes spaced below and substantially parallel to the operating plane, said top part having a top hole formed therethrough, said top hole having a diameter sufficiently greater than said predetermined diameter to accommodate said rod loosely, said bottom part having a bottom hole formed therethrough, said top and bottom holes pivotally accommodating said rod with the first end of said rod passing through said bottom hole and the area of the end of said linear part adjacent the bent area of said rod passing through said top hole and most of said linear part of said rod being in said housing and the bent area of said rod being outside of said housing, said rod being severed in its linear part at a point outside said housing and above the top part of said housing; and rod coupling means at the severed ends of the linear part of said rod for removably joining said severed ends to each other thereby permitting differently bent second end areas of said rod to be coupled to said linear part thereof to enable said sliding door safety device to be mounted at opposite ends and on opposite sides of said door.

2. A sliding door safety device as claimed in claim 1, wherein said rod is severed at a point where its linear part meets its first arm.

3. A sliding door safety device as claimed in claim 1, wherein said rod coupling means comprises external threading at one of said severed ends, an eye member extending from the other of said severed ends for accommodating said one of said ends and a nut threadedly coupled to said one of said ends for retaining said eye member tightly on the said one of said ends whereby said ball is movable with said rod.

4. A sliding door safety device for a sliding door slidably mounted in a door frame having a track slidably accommodating the door, said door having a leading edge which abuts the frame when the door is closed and a leading surface in the area of the leading edge, said frame having a leading surface which is next-adjacent the leading surface of the door when the door is closed, said sliding door safety device comprising a resilient ball;

support means pivotally supporting the resilient ball on one of the leading surface of the door and the leading surface of the frame in a manner whereby the gravitational force on said ball moves said ball between the door and the frame, said ball being manually movable away from said door and said frame, so that said ball is positioned by gravitational force in abutment with the leading surface of one of said frame and said door when said door is closed thereby permitting said door to be securely closed with its leading edge in abutment with said frame, and is interposed by gravitational force between said leading edge of said door and said frame when said door is open thereby preventing the door from closing fully by preventing said leading edge of said door from abutting said frame and thus protecting hands from being crushed between said door and said frame, said support means comprising a rod of predetermined diameter having spaced opposite first and second ends, said rod having a linear part extending for most of its length from the first end and being bent in the area of its second end in a manner whereby said second end is spaced at a substantially radial distance from said linear part, said rod being bent in the area of its second end at substantially right angles with said linear part to form a first arm extending from the end of said linear part adjacent said bent area, said first arm and said linear part forming a first support plane, and said rod being bent again at the end of said first arm farthest from said linear part at substantially right angles with said first arm to form a second arm extending from said end of said first arm, said first and second arms forming said operating plane perpendicular to said first support plane and to said linear part, said ball being mounted on the second end of said rod, and mounting means for pivotally mounting said rod at an acute angle with one of said leading surface of said door and said leading surface of said frame in a manner whereby said ball is rotatable in an operating plane perpendicular to said linear part and at an acute angle with one of said leading surface of said door and said frame, said mounting means comprising a housing affixed to one of said leading surface of said door and said leading surface of said frame and having spaced substantially parallel top and bottom parts extending in planes spaced below and substantially parallel to the operating plane, said top part having a top hole formed therethrough, said top hole having a diameter sufficiently greater than said predetermined diameter to accommodate said rod loosely, said bottom part having a bottom hole formed therethrough, said top and bottom holes pivotally accommodating said rod with the first end of said rod passing through said bottom hole and the area of the end of said linear part adjacent the bent area of said rod passing through said top hole and most of said linear part of said rod being in said housing and the bent area of said rod being outside of said housing, said second arm of said rod being severed; and arm coupling means at the severed ends of said second arm for removably joining said severed ends to each other thereby permitting said second arm to be selectively varied in length.

5. A sliding door safety device as claimed in claim 4, wherein said arm coupling means comprises a first tubular part extending coaxially from one of the severed ends of said second arm and having a plurality of spaced radial holes formed therethrough and a second tubular part extending coaxially from the other of the severed ends of said second arm and dimensioned to slide in axial directions in said first tubular part, said second tubular part being axially slidably mounted in said first tubular part and having a protrusion extending radially therefrom at the free end thereof for extending into each of said holes when it is positioned thereat thereby releasably securing said second tubular part at a selected one of a plurality of different positions indicated by said holes thereby selectively varying the length of said second arm, said protrusion leaving a hole into which it extends under manual pressure applied to slide said second tubular part in said first tubular part.

* * * * *